US005730100A

United States Patent [19]

Bergsten

[11] Patent Number: 5,730,100

[45] Date of Patent: Mar. 24, 1998

[54] FUEL INJECTION ARRANGEMENT WITH IGNITION PLUG FUNCTION

[76] Inventor: Lars Bergsten, Vallmostigen 7, S-153 31 Jarna, Sweden

[21] Appl. No.: 817,612

[22] PCT Filed: Oct. 24, 1995

[86] PCT No.: PCT/SE95/01256

§ 371 Date: Apr. 24, 1997

§ 102(e) Date: Apr. 24, 1997

[87] PCT Pub. No.: WO96/13660

PCT Pub. Date: May 9, 1996

[30] Foreign Application Priority Data

Oct. 27, 1994 [SE] Sweden ..... 9403675

[51] Int. Cl.[6] ..... F02M 57/06; F02P 15/04

[52] U.S. Cl. ..... 123/297; 313/120

[58] Field of Search ..... 123/297, 169 V, 123/162; 313/120

[56] References Cited

U.S. PATENT DOCUMENTS 3,855,972 12/1974 Roberts ..... 123/297

4,450,795 5/1984 Schaich ..... 123/79 C 4,967,708 11/1990 Linder et al. ..... 123/297

FOREIGN PATENT DOCUMENTS 0555520 8/1993 European Pat. Off. .

8707682 12/1987 WIPO .

*Primary Examiner*—Andrew M. Dolinar

[57] ABSTRACT

Arrangement (2) for fuel injection and ignition of a fuel/air mixture in the combustion chamber (6) in a cylinder (10) provided with a reciprocating piston (8) in a combustion engine. The arrangement includes a tubular retaining body (32) which constitutes an insulator and which is fastenable in the engine cylinder head (14), and a tubular valve housing (44) which runs axially through the retaining body and which has running through it a valve needle (48) with central fuel supply passage (50), and the end (44) of the valve housing (44) in the combustion chamber constitutes a free end provided with a valve seat (52) which accommodates a valve element (54) which is fastened in the end of the valve needle and can be applied to the seat. The valve housing (44), the valve needle (48) and the valve element (54) form together a central electrode in a single-pole ignition plug, the second electrode of which is an electrode (30) firmly attached to the piston (8) or to the cylinder (10).

16 Claims, 3 Drawing Sheets

+
-
100
108
104
106
80
84
84
102
74
74
68
70
76
2
50
32
48
44
4
38
42
40
14
46
32
18
16
22
20
34
44'
36
6
24
10
28
30
26
8
12

FUEL INJECTION ARRANGEMENT WITH IGNITION PLUG FUNCTION

The present invention relates to a fuel injector and, particularly, to a combined fuel injector and ignition plug.

STATE OF THE ART

In recent years, so-called four-valve technology has come to be increasingly used in combustion engines, more particularly in vehicle engines of the Otto type. In such an engine it is usual for each cylinder to be provided with two inlet valves (intake valves) and two outlet valves (exhaust valves), resulting respectively in improved engine loading and more effective exhaust gas removal. As not only the four valves but also an ignition plug have to be accommodated in the cylinder's upwardly delineating combustion chamber wall (the cylinder top) on the underside of the cylinder head, possibilities for the valves and the ignition plug to be situated at functionally optimum points are obviously limited. In cases where it is also intended that fuel injection should take place not in the inlet pipe (the injection pipe) upstream of the respective inlet valve but directly into the combustion chamber, there is the additional problem of accommodating the injector in the combustion chamber wall on the underside of the cylinder head.

Today's four-valve technology and the positioning of the inlet valves or injection valves which cooperate with fuel injectors thus involve considerable problems with regard to being able in an advantageous and, from a fuel consumption point of view, optimum manner to supply fuel to and direct the stream of finely divided fuel into the combustion chamber. Cylinder head configurations at present being discussed and, still more, those desired in the future involve still more limited and hence worse situations for selecting the optimum injector position in the inlet pipe.

It is thus for various reasons desirable to adopt a fuel injection installation which makes it possible for fuel injection to take place centrally and directly into the combustion chamber and this preferably in the region of the ignition plug well.

Various technical solutions for incorporating injectors and ignition plugs in an injector arrangement combined with ignition plug devices are previously known, see for example U.S. Pat. No. 4,967,708, which describes a fuel injector provided with annularly arranged pairs of cooperating axially directed threadlike electrodes which protrude from respectively earthed and high-voltage parts of the injection arrangement. However, the electrode version adopted is complicated and bulky and involves the same disadvantages as are inherent in conventional ignition plugs, namely that the electrode separation (the spark gap) changes and becomes incorrect partly because of contamination such as soot on the electrodes, fusion beads on the insulator foot and other kinds of deposits on the electrodes, and partly because of burnt electrodes. In the known injection arrangement, incorrect electrode separation means that the whole arrangement has to be replaced, resulting in substantially higher maintenance costs than for replacing a conventional ignition plug. This known arrangement also means that the electrodes connected to earth protrude into the region through which the fuel passes, resulting in the fuel distribution in the cylinder being more or less influenced by the electrodes.

OBJECTS OF THE INVENTION

The present invention is therefore based inter alia on one or more of the following objects:

- to provide a new type of injector arrangement comprising an injector which is combined with an injection plug, has only one central electrode and has as its second electrode another suitable surface in the combustion chamber, e.g. a portion of the piston which is designed as an electrode, whereby the ignition spark normally strikes through the whole combustion chamber and through a centrally injected fuel/air plume;
- fuel injection directly and centrally into the combustion chamber for optimum fuel localisation without obstruction by internally protruding electrodes;
- fuel injection taking place from a central electrode at the end of the injector arrangement;
- the possibility of fuel proportioning (fuel feed) being effected by means of shotlike compressed air pulses;
- the possibility of fuel being ionised/electrostatically treated so that further fine division of it in the combustion chamber results from drops of liquid in the fuel spray being kept suspended in the combustion chamber because they have the same charge and hence repel one another and being prevented from being deposited on metal surfaces in the combustion chamber by the fact that these surfaces have a corresponding charge;
- to avoid the conventional ignition plug problem of electrode separation (spark gap) changes over time, so that replacement of the injector arrangement, which also functions as such an ignition plug, can take place at longer intervals of time than in the case of a conventional ignition plug.

DESCRIPTION OF THE INVENTION

The type of injector to which the present invention relates is intended for injection of fuel and ignition of a fuel/air mixture in the combustion chamber in a cylinder provided with a reciprocating piston in a combustion engine, preferably an Otto engine suitable for vehicle operation. In quite general terms, the arrangement comprises a tubular retaining body which constitutes an insulator and is fastenable in the engine cylinder head, and a likewise tubular valve housing which runs axially through the retaining body and surrounds and has running through it a valve needle acting as valve stem which delineates a longitudinal fuel supply passage. The valve housing end which is nearer to the combustion chamber is arranged to protrude into the combustion chamber from the retaining body and form there a free end in which there is a valve seat which is in communication with the fuel supply passage and accommodates a valve element which is fastened to the adjacent end of the valve needle and can be applied to the seat.

The distinguishing features of the injector arrangement according to the invention include the fact that the valve needle, which is arranged for axial movement in the valve housing, has a central fuel supply passage running through it and the fact that the valve housing, the valve needle and the valve element form together an electrically conducting unit which constitutes an electrode in a single-pole ignition plug.

It is advantageous that the retaining body be surrounded by a base nut whereby its end which is nearer to the combustion chamber may be clamped, via intermediate spring devices, in an accommodating hole in the cylinder head, preferably in the so-called ignition plug well. This means that an injector arrangement according to the invention results in very effective utilisation of available space at the cylinder top, a factor of particular significance if the engine has two or more inlet and exhaust valves for each cylinder, as for example in four-valve engines. The new type of injector arrangement means that fuel consumption can be reduced and low exhaust emissions and rapid response achieved. The fact that fuel is injected directly into the cylinder obviates duct wall wetting and means that the fine division of fuel in the combustion chamber can be effected partly by compressed air assistance and partly by ionisation. The fact that the whole injector installation is accommodated in an existing ignition plug well also makes it possible to adopt new and alternative types of valve mechanism layouts.

It is advantageous that the central fuel supply passage in the valve needle end axially in the region where the rear part of the valve element is in communication with the outside of the needle via two or more (e.g. four) holes which are directed radially in the valve stem and debouch in the immediate vicinity of the rear side of the valve element. In this case it is advantageous that the valve housing in the region of the rear narrower part of the valve seat be provided with an annular groove in its inner wall surface adjacent to the valve needle. This groove is in its turn in open communication laterally with the narrower part of the valve seat. The fact that the fuel supply passage is a central duct inside the valve needle means that the needle can be guided in the surrounding tubular valve housing along the whole of its shell surface, thereby eliminating the risk of the valve needle buckling sideways. This design also means that outflowing fuel will bounce off the valve seat, thereby not only deflecting the fuel in a suitable direction in the cylinder but also further finely dividing it.

It is advantageous that the valve seat be a recess situated in the forward end of the valve housing and tapering cortically inwards towards the valve needle and that in that case the valve element have a corresponding conical sealing surface on its rear face which is directed inwards towards the valve seat.

A constructionally simple embodiment of the injector arrangement includes, in the region axially behind the retaining body, a drive unit, provided with external insulation, for operating the valve needle and the valve element. This drive unit includes an elastically flexible running membrane which has its outer edge portion clamped to the outside of a supporting sleeve itself connected firmly to the valve housing and has its inner edge portion clamped to the outside of the valve needle end portion protruding axially rearwards from the valve housing. In this case it is advantageous that the ignition plug cable extend in through the external insulation of the drive unit and have an uninsulated section of conductor in electrical contact with the outside of the supporting sleeve, which is screwed firmly onto an externally threaded rear end portion of the valve housing. It is then advantageous that the insulation on the outside of the drive unit include a sleeve-shaped rear section which surrounds the drive unit and which axially behind the running membrane surrounds and is clamped about porcelain body with a central fuel supply hole.

Within the supporting sleeve it is advantageous that an axially adjustable spring dolly be arranged on the outside of the valve needle and that a return spring, e.g. a coil spring, be clamped between this dolly and a rearward-facing surface of the rear end portion of the valve housing and exert on the valve needle, and hence on the valve element, a force acting in the valve closing direction. It is advantageous that the sparkgap-defining part of the central electrode unit of the injector arrangement consist of a central pinlike electrode end portion on the valve element's outside facing into the combustion chamber.

It is possible to connect to the aforesaid porcelain body in the sleeve-shaped rear section of the insulation a fuel proportioning unit which includes an electrically controlled fuel supply valve combined with a likewise electrically controlled solenoid valve for controlled supply of compressed air pulses whereby fuel supplied to the inside of the injector arrangement via the fuel supply valve can be caused to be injected shot by shot into the combustion chamber in the cylinder at the same time as each opening of the valve takes place.

BRIEF DESCRIPTION OF THE DRAWINGS

The invention will now be described and explained below with reference to the attached drawings which illustrate an embodiment of the injector arrangement according to the invention, as follows.

DESCRIPTION OF EMBODIMENTS

Figure 1:
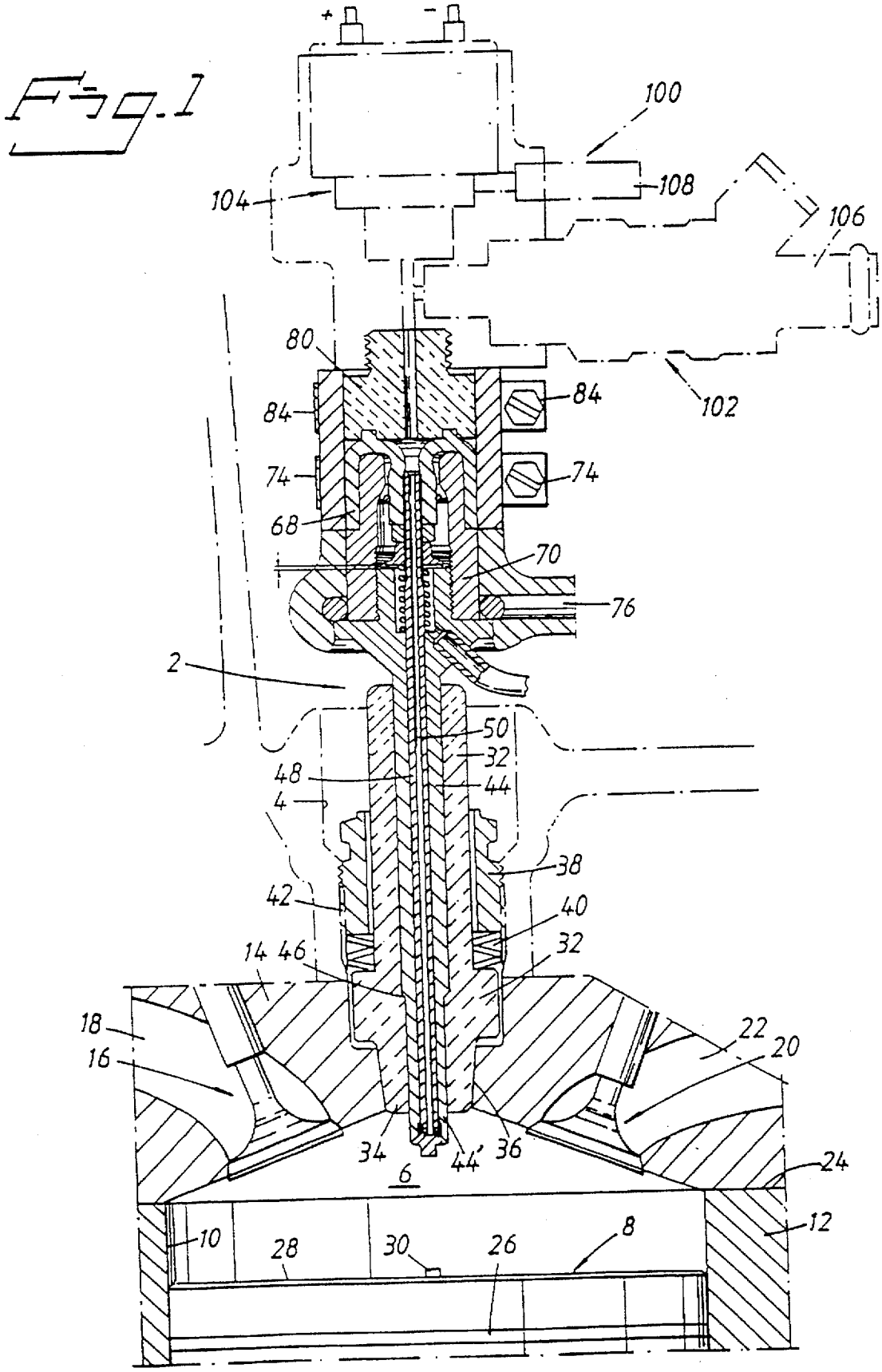
FIG. 1 shows in vertical projection a longitudinal section through an injector arrangement according to the invention.

FIG. 1 depicts a section through an injector arrangement 2 which is fastened in an ignition plug well 4 which debouches downwards into a combustion chamber 6 in a cylinder 10 provided with a reciprocating piston 8 in an otherwise undepicted Otto engine. The embodiment described refers to an injector arrangement for one cylinder in the engine, but in the case of engines which contain several cylinders, e.g. four or six cylinders, each cylinder is provided with similar injector arrangements. The function of the injector arrangement 2 is to inject fuel and ignite the fuel/air mixture in the combustion chamber 6. The cylinder 10 is located in the engine cylinder block 12 and the injector arrangement 2 is fitted in the engine cylinder head 14. The cylinder 10 is conventionally provided with at least one inlet valve 16 which operates where the inlet pipe 18 debouches into the combustion chamber 6, and with at least one exhaust valve 20 which operates at the orifice to the exhaust pipe 22 leading from the combustion chamber 6. The dividing plane between the cylinder head 14 and the cylinder block 12 is designated 24. A piston ring on the piston 8 is designated 26 and the piston top which constitutes the lower boundary wall of the combustion chamber 6 is designated 28. At the centre of the piston top 28 there is an electrode 30 firmly attached to the piston 8.

The injector arrangement 2 includes a tubular retaining body 32 which is made of ceramic material and which constitutes an insulator. The retaining body 32 has an end portion 34 tapering conically downwards which fits into a corresponding conical aperture 36 which constitutes the connection between the ignition plug well 4 and the combustion chamber 6. The retaining body 32 is surrounded, with radial clearance, by an externally threaded base nut 38 whereby the end portion 34 of the retaining body can be clamped, via intermediate cup spring devices 40, into the aperture or accommodating hole 36 in the cylinder head 14.

The externally threaded base nut 38 is screwed into a lower part of the ignition plug well 4 which is provided with threads 42.

The tubular retaining body 32 has running through it axially a likewise tubular valve housing 44 which by means of a shoulder 46 is both axially fixed in and centred to the retaining body 32. The valve housing 44 in its turn has running through it axially a valve stem in the form of a valve needle 48 which itself has running through it axially a central passage 50 for batched supply of fuel to the combustion chamber 6. The end 44' of the valve housing 44 which is nearer to the combustion chamber protrudes into the combustion chamber 6 from the retaining body 32 and has arranged in it a valve seat 52 (see particularly FIG. 3) which is in communication with the fuel passage 50 in the valve needle 48. This valve seat 52 accommodates a valve element 54 which is fastened in the end of the valve needle 48 and can be applied to the seat 52. This valve element 54 may be fastened in the end of the valve needle 48 or form the outermost end section of the valve needle 48. The fact that the valve needle 48 is arranged for axial movement in the tubular valve housing 44 means that the valve element 54 can be manoeuvred relative to the end seat 52 of the valve housing 44, as particularly depicted in FIG. 3, the upper half of which shows the valve element 54 in its closed position, while the lower half of the diagram shows the valve element in its open position away from the seat 52, thereby forming an annular gap 56 between the seat 52 and the adjacent surface 62 of the valve element 54.

The valve housing 44, the valve needle 48 and the valve element 54 are made of electrically conducting material and form together an electrode positioned centrally in the injector arrangement, which in this respect constitutes a single-pole ignition plug (or more exactly a so-called piston spark ignition plug), the second electrode of which is the electrode 30 firmly attached to the piston 8. As may be seen in FIG. 3, the valve element 54 has on its outside facing the combustion chamber 6 a central pinlike end portion 58 which constitutes a sparkgap-forming part of the piston spark ignition plug.

Figure 3:
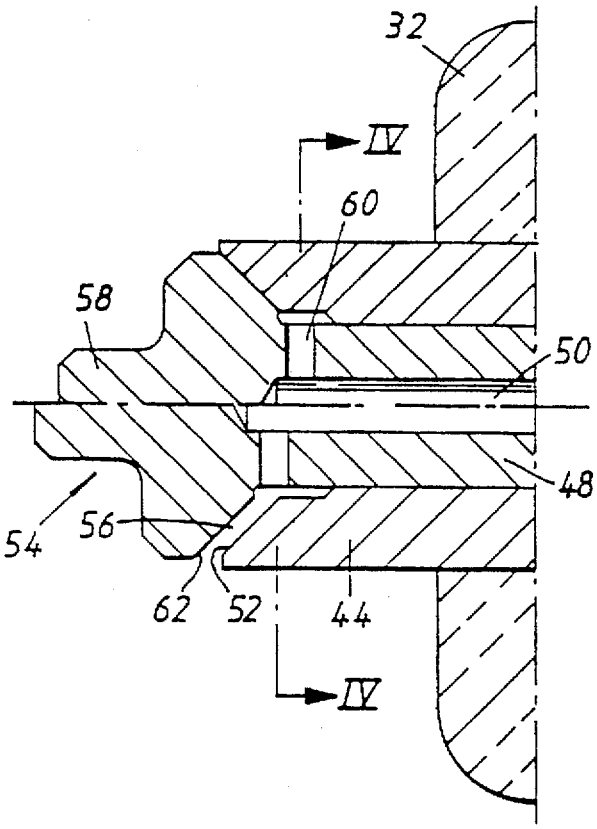
FIG. 3 shows on a still larger scale a partial longitudinal section through the valve housing end situated in the combustion chamber, with the associated valve needle and valve element depicted in the respective closed and open positions of the valve.
Figure 4:
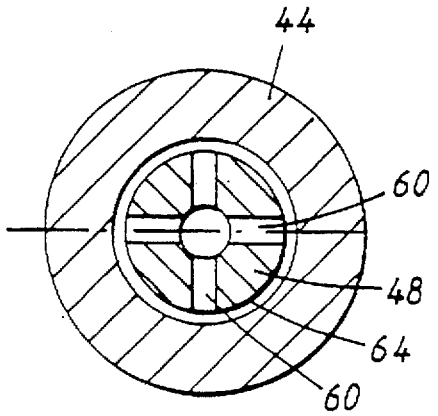
FIG. 4 shows a cross-section through the valve housing end according to FIG. 3, along the section line IV—IV in FIG. 3.

As illustrated in FIG. 3, the central fuel supply passage 50 in the valve needle 48 extends axially to the region of the rear part of the valve element 54 where the passage 50 is in communication with the outside of the needle via four radial holes 60 which debouch in the immediate vicinity of the conical rear side 62 of the valve element 54. In the region of the innermost part of the valve seat 52 the valve housing 44 has an annular groove 64 in its inner wall surface adjacent to the valve needle 48. This groove 60 is in open communication laterally with the radially innermost part of the valve seat 52. The upper half of FIG. 3 depicts the sealed position in which the conical surface 62 of the valve element 54 abuts sealingly against the corresponding conical surface of the valve seat 52.

Figure 2:
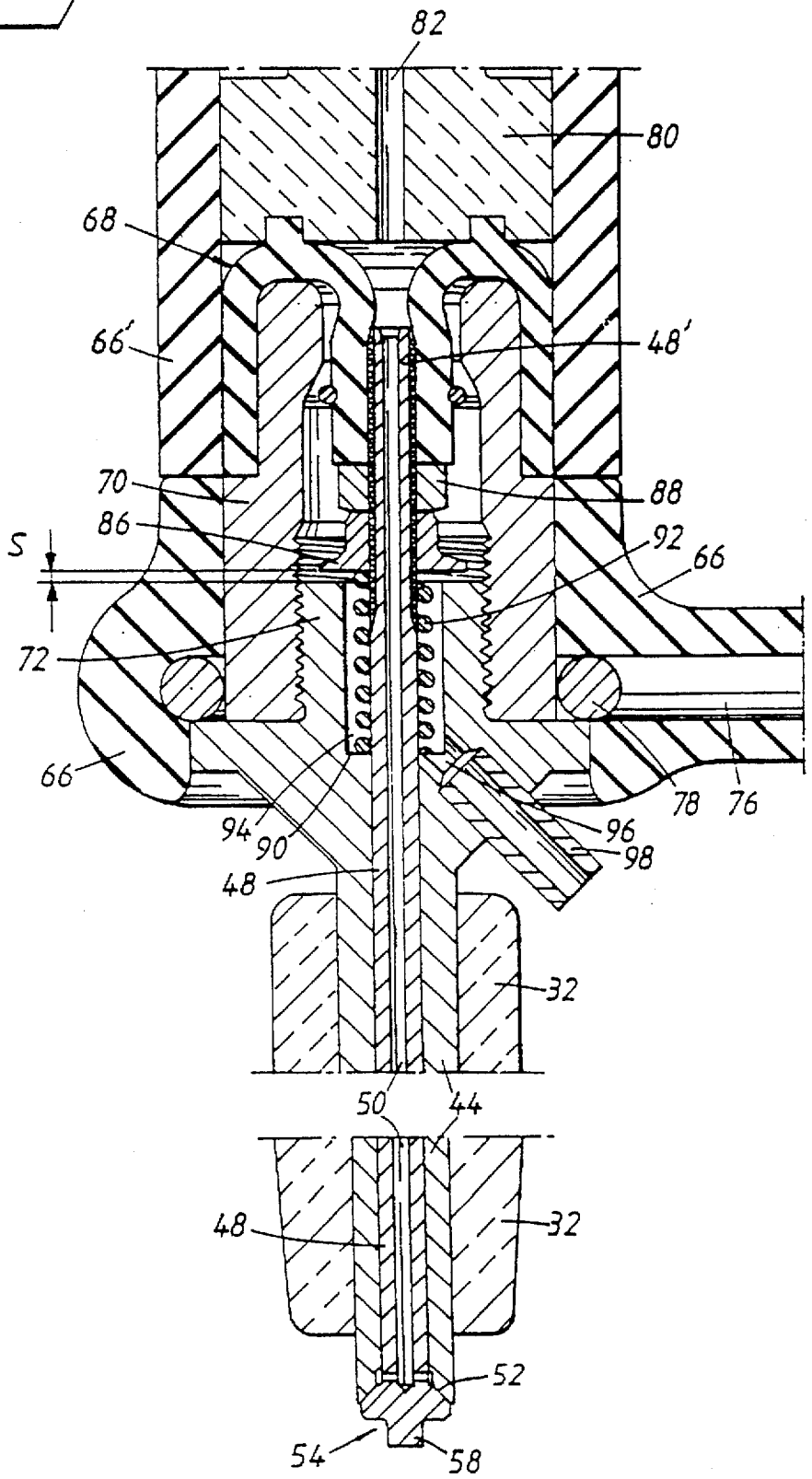
FIG. 2 shows on a larger scale the essential parts of the arrangement according to FIG. 1.

Reference is now made to FIG. 2, which depicts a central section of the injector arrangement 2 and shows that in the region axially behind (i.e. above, according to the diagram) the retaining body 32 the arrangement includes a drive unit, provided with external insulation 66, 66', for operating the valve needle 48 and the valve element 54 situated in the end of the needle. This drive unit includes an elastically flexible running membrane 68 which has its outer edge portion clamped to the outside of a supporting sleeve 70 which is connected to the widened rear end part of the valve housing 44 and which by means of an internal thread is firmly screwed onto an externally threaded end portion 72 of the valve housing 44. The clamping of the outer edge part of the running membrane 68 is by means of a retightenable clamp 74 (see FIG. 1 ) about the insulation 66'. The inner edge portion of the running membrane 68 is in its turn clamped to the outside of the end portion 75 of the valve needle 48 which protrudes axially rearwards from the valve housing 44.

An ignition plug cable 76 extends in through the insulation 66 applied to the outside of the drive unit and has an annular uninsulated conductor section 78 in electrical contact with the outside of the supporting sleeve 70, which is made of electrically conducting material.

The insulation on the outside of the drive unit thus includes a rear sleeve-shaped section 66' which surrounds the drive unit and which in the region axially behind (i.e. above, as here depicted) the running membrane 68 surrounds and is clamped about a porcelain body 80 with a central hole 82 for the batched fuel supply. The clamping of the insulating part 66' about the porcelain body 80 is by means of an embracing retightenable clamp 84 (see FIG. 1).

Within the supporting sleeve 70, the outside of the valve needle end portion 74 has arranged on it a spring dolly 86 which is adjustable axially, e.g. by screwing, and which may be firmly lockable in a desired position by means of a locknut 88. A helicoidal return spring 92 is clamped between this doily 86 and a rearward-facing surface 90 in the rear end portion 72 of the valve housing and exerts on the valve needle 48 and hence on the valve element 54 a force which endeavours to keep the valve element in closed contact with the valve seat 52. The space 94 in which the coil spring 92 is arranged is in communication, via an opening 96 and an adjoining pipe sleeve 98, with a suitable ventilation space, e.g. the engine crankcase, to prevent pressure build-up in the spring-accommodating space 94. The travel of the valve needle 48 is designated S and is set by the spring doily 86 being adjusted to a suitable position relative to the valve needle 48 and the locked by means of the locknut 88.

Reference is now made again to FIG. 1, which has chain-dotted outlines depicting other equipment items connected to the injector arrangement 2. The porcelain body 80 thus has connected to it a fuel proportioning unit 100 which includes an electrically controlled fuel supply valve 102 combined with a likewise electrically controlled solenoid valve 104. Fuel enters the fuel supply valve 102 via the connecting branch 106 and is injected at suitable times and in suitable quantities into the inside of the injector arrangement 2. The solenoid valve 104 is supplied with compressed air from a suitable compressed air source via the pipe connection 108. The function of the electrically controlled solenoid valve 104 is to provide a controlled supply of compressed air pulses whereby the fuel supplied via the fuel supply valve 102 to the inside of the injector arrangement 2 can be caused, by opening of the valve element 54, to be propelled, portion by portion and shot by shot, into the combustion chamber 6 via the fuel passage 50, the hole 60 and the annular gap 56.

The electrically driven and controlled injector arrangement 2 according to the invention is intended to form part of an electrically controlled fuel injection system which operates continuously when the engine is running. The functions which are essential for the operating characteristics of the engine and therefore have to be taken into account are recorded continuously by a number of sensors which deliver electrical signals to an electronic control unit, advantageously in the form of a computer, which on the basis of the engine parameters concerned determines when each injection arrangement 2 has to be caused to inject fuel into the associated cylinder and what quantity of fuel has to be injected. The engine parameters on which this control is based may be the same as for today's more conventional fuel injection systems, in which case the injector arrangement 2 is activated by operation of the fuel proportioning unit 100, i.e. the fuel supply valve 102 and the solenoid valve 104, which put the supplied fuel under pressure inside the injector arrangement 2 and thereby overcome the valve closing force exerted by the spring 92, so that the valve element 54 is pushed away from the seat 52 by a distance corresponding to the valve needle travel S, thereby allowing fuel to be injected into the cylinder 10 in the form of a plume of very finely divided fuel drops. The injector arrangement may also be arranged to cause the fuel drops to be ionised or electrostatically treated so that they acquire the same charge and hence repel one another. They thus remain suspended for a longer time in the combustion chamber, so that more effective mixing with the air drawn in is obtained before ignition is effected by the electronic system initiating an igniting spark between the electrode end portion 58 and the electrode 30 attached to the piston 8. This electrostatic charging of fuel drops may be achieved by using the same electrical connections as are also used for providing ignition sparks, but in that case the valve needle 48 is energised for the period during which the fuel is sprayed through it.

The above example describes a piston spark ignition plug cooperating with a second electrode on the top of the piston. In alternative embodiments the second electrode may take the form of any other suitable surface in the cylinder, which need not necessarily be a defined surface. It is thus possible to utilise any of the surfaces delineating the cylinder as a second electrode, both the cylindrical surface and/or the surfaces situated at its ends, i.e. either a surface of the cylinder head or of the piston. The piston spark ignition plug may therefore also consist of other forms of single-pole ignition plug which cooperate with an earth electrode in the cylinder. Particularly in cases where the arrangement according to the invention is utilised in an engine with variable compression in which the cylinder head may be angled relative to the engine crankcase section, the distance between pistons and single-pole ignition plugs at low compression may be relatively great and in such cases the ignition spark may occur more readily between the ignition plug and the cylinder wall/cylinder head than between the ignition plug and the piston. The spark thereby created is quite sufficient for satisfactory ignition of the fuel mixture in the cylinder even if does not extend through the whole cylinder. What is essential is that this second electrode is not connected to the fuel injection arrangement/ignition plug so as to be able to influence or disturb the distribution of the fuel injected into the cylinder.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. Arrangement for injection of fuel and ignition of a fuel/air mixture in the combustion chamber in a cylinder having a cylinder head, which arrangement comprises:

a valve support unit having a bore opening into the combustion chamber, the valve support unit being fastenable in the cylinder head;

a valve needle disposed in and movable in the bore of the valve support unit, the valve needle having a longitudinal fuel passage therein and having an end extendable into the combustion chamber, the valve needle being movable in directions toward and away from the combustion chamber;

a valve seat arranged at one end of the valve support unit in communication with the fuel supply passage;

a valve element at the end and of the valve needle extendable into the combustion chamber, the valve element upon movement of the valve needle in a direction away from the combustion chamber being engageable with the valve seat; and the valve support unit, the valve needle and the valve element being conductive and together forming an electrode of a single-pole ignition plug.

2. Arrangement according to claim 1, wherein the fuel supply passage in the valve needle ends axially in the region of the valve element and is in communication thereat with the outside of the needle via at least two holes directed radially outwardly of the fuel supply passage.

3. Arrangement for injection of fuel and ignition of fuel/air mixture in the combustion chamber in a cylinder having a cylinder heat provided with a reciprocating piston in a combustion engine, which arrangement comprises:

a tubular retaining body which is fastenable in the engine cylinder head bore;

a tubular valve housing disposed in the retaining body;

a valve needle movably disposed in the valve housing for movement towards and away from the combustion chamber, the valve needle having a longitudinal passage for fuel supply;

a valve seat arranged at one end of the valve housing in communication with the fuel supply passage;

a valve element fastened to an end of the valve needle and engageable with the seat upon movement of the valve needle away from the combustion chamber; and the valve housing, the valve needle and the valve element being conductive and together forming an electrode of a single-pole ignition plug.

4. Arrangement according to claim 3, wherein the valve housing has an annular groove in an inner wall surface adjacent to the valve needle, which groove is open laterally towards the valve seat.

5. Arrangement according to claim 4, wherein the valve seat is a recess in an end of the valve housing which tapers conically inward towards the valve needle, and wherein the valve element has a corresponding conical sealing surface on its rear side facing inward towards the valve seat.

6. Arrangement according to claim 3, wherein the valve element has on its outside facing towards the combustion chamber a central pinlike electrode end portion.

7. Arrangement according to claim 3, further comprising a fuel proportioning unit including an electrically controlled fuel supply valve combined with an electrically controlled solenoid valve for controlled supply of compressed air pulses for supplying bursts of fuel via the fuel supply valve to the fuel supply passage of the valve needle.

8. Arrangement according to claim 3, further comprising:

a base nut which surrounds the retaining body and which via intermediate spring devices clamps the retaining body in an accommodating hole in the cylinder head;

a drive unit provided with external insulation for operating the valve needle and the valve element, which drive unit includes an elastically flexible running membrane which has its outer edge portion clamped to the outside of a supporting sleeve connected firmly to the valve housing and has its inner edge portion clamped to the outside of an end portion of the valve needle which protrudes axially rearward from the valve housing.

9. Arrangement according to claim 8, wherein an ignition plug cable extends in through the insulation applied to the outside of the drive unit and has an insulated conductor section in electrical contact with the outside of the supporting sleeve, the supporting sleeve being screwed firmly onto an externally threaded rear end portion of the valve housing.

10. Arrangement according to claim 9, wherein inside the supporting sleeve there is arranged on the outside of the valve needle an axially adjustable spring dolly and wherein a return spring is clamped between the dolly and a rear-facing surface of the rear end portion of the housing and exerts on the valve needle and on the valve element a force in a direction to keep the valve element in closed contact with the valve seat.

11. Arrangement according to claim 10, wherein the fuel supply passage in the valve needle ends axially in the region of the valve element and is in communication thereat with the outside of the needle via at least two holes directed radially outwardly of the fuel supply passage.

12. Arrangement according to claim 11, wherein the valve housing has an annular groove in an inner wall surface adjacent to the valve needle, which groove is open laterally towards the valve seat.

13. Arrangement according to claim 12, wherein the valve seat is a recess in an end of the valve housing which tapers conically inward towards the valve needle, and wherein the valve element has a corresponding conical sealing surface on its rear side facing inward towards the valve seat.

14. Arrangement according to claim 13, wherein the valve element has on its outside facing towards the combustion chamber a central pinlike electrode end portion.

15. Arrangement according to claim 14, further comprising a fuel proportioning unit including an electrically controlled fuel supply valve combined with an electrically controlled solenoid valve for controlled supply of compressed air pulses for supplying bursts of fuel via the fuel supply valve to the fuel supply passage of the valve needle.

16. Arrangement according to claim 8, wherein the insulation on the outside of the drive unit includes a rear sleeve-shaped section which surrounds the drive unit and which in the region axially behind the running membrane surrounds and is clamped about a porcelain body with a central hole for supply of fuel.

* * * * *